US009406464B2

(12) United States Patent
Montano

(10) Patent No.: US 9,406,464 B2
(45) Date of Patent: Aug. 2, 2016

(54) LIGHT SWITCH EXTENDER

(71) Applicant: Robert L. Montano, Buena Park, CA (US)

(72) Inventor: Robert L. Montano, Buena Park, CA (US)

( * ) Notice: Subject to any disclaimer, the term of this patent is extended or adjusted under 35 U.S.C. 154(b) by 0 days.

(21) Appl. No.: 14/312,181

(22) Filed: Jun. 23, 2014

(65) Prior Publication Data

US 2015/0371795 A1 Dec. 24, 2015

(51) Int. Cl.
*H01H 3/20* (2006.01)
*H01H 17/00* (2006.01)
*H01H 23/14* (2006.01)

(52) U.S. Cl.
CPC ..... *H01H 23/141* (2013.01)

(58) Field of Classification Search
CPC ..... H01H 23/141; H01H 3/36
USPC ..... 200/331, 330
See application file for complete search history.

(56) References Cited

U.S. PATENT DOCUMENTS

| | | | | | |
|---|---|---|---|---|---|
| 2,582,379 | A * | 1/1952 | Goldberg | 200/331 | |
| 4,562,325 | A * | 12/1985 | De Rouen | 200/331 | |
| 5,017,746 | A * | 5/1991 | Guimarin | 200/331 | |
| 5,380,967 | A * | 1/1995 | Steen et al. | 200/331 | |
| 5,396,037 | A * | 3/1995 | Moore et al. | 200/331 | |
| 5,498,845 | A * | 3/1996 | Browning | 200/331 | |
| 6,403,903 | B1 * | 6/2002 | Montano et al. | 200/331 | |
| 6,822,177 | B1 * | 11/2004 | LaPlante | 200/331 | |
| 7,038,153 | B2 * | 5/2006 | Zamecnik | 200/330 | |
| 2011/0073450 | A1 * | 3/2011 | Wass | H01H 23/141 200/331 | |

* cited by examiner

*Primary Examiner* — Renee Luebke
*Assistant Examiner* — Lheiren Mae A Caroc
(74) *Attorney, Agent, or Firm* — Donn K. Harms

(57) ABSTRACT

A light switch extension, allowing shorter individuals and seated individuals to operate a conventional light switch. The wall switch extender is operable without modification on both toggle and rocker switches and reduces the rotational displacement necessary to toggle rocker switches. The extension arm can also have additional extensions which increase the arm's ergonomics, as well as length below or above the switch, and can extend to the floor for wheelchair activation or dog-manipulateable extensions such as ropes or tennis balls.

4 Claims, 6 Drawing Sheets

LIGHT SWITCH EXTENDER

FIELD OF THE INVENTION

A wall switch extension is provided for operation of a wall switch in which a single rigid extension once attached, will operate either of a conventional toggle switch, or a rocker type wall switch. The extension includes methods for engaging the lever of the toggle switch and the operating surface of the rocker. Upon following an arc or partial rotation of the extension in its operative engagement with the wall switch, either of a toggle or rocker switch can be turned on or turned off from the distal end of the extension.

BACKGROUND OF THE INVENTION

The invention is directed to a toggle or pivotal switch and more particularly to an extension for switch activation by a person that cannot normally reach the conventional switch operator.

U.S. Pat. No. 5,557,602 (602) teaches a switch extender for ether a toggle switch and when modified for use on a rocker switch. To use the extender for the switch activation, the face plate attached to a conventional wall switch is translated up and down activating a toggle switch and when modified actuates a rocker type wall switch in as similar manner. The face plate appears to have a limited switch operator extension. The extender of this invention requires a modification for use with a rocker switch. While a major advance in the filed of light switch activation, the (602) patent has shortcomings in that the toggle switch length varies widely due to differing manufactures. Consequently the hole adapted to engage the distal end of the toggle switch in the (602) patent on many switches will not properly engage, or activate them. Additionally, the width and length of rocker switches also varies widely due to design and manufacturer differences and such are also not always activated by the (602) patent as taught.

U.S. Pat. Nos. 5,055,645, 5,017,746 and 3,825,710 operated a toggle switch by up and down action rather than rotational movement as Applicant's and cannot be used with rocker type switches.

U.S. Pat. No. 4,562,325 teaches a rotary type toggle switch operator. The rotation requires the operation of two individual activation pull cords, i.e. one for turning the switch on and a second for turning the switch off. There is no operator means for use with a rocker type switch.

Finally, U.S. Pat. No. 6,403,903 displays an device capable of adapting to both toggle and rocker switches, but requires the operator to rotate the device about a wide encumbering angle for rocker switch activation.

As such, there exists an unmet need, for a light switch extension, allowing shorter individuals and seated individuals to operate a light switch. Such a device should accommodate and operate toggle switches which vary widely in length to the distal end projecting above their cover. Such a device should concurrently be able to operate a rocker style switch and accommodate the wide variance in width and length of such rocker switches which has arisen in recent years due to ornamental and design differences among different manufacturers.

The forgoing examples of related art and limitation related therewith are intended to be illustrative and not exclusive, and they do not imply any limitations on the invention described and claimed herein. Various limitations of the related art will become apparent to those skilled in the art upon a reading and understanding of the specification below and the accompanying drawings.

OBJECTS OF THE INVENTION

The principal object of the instant invention is to provide a conventional wall switch extension which accommodates short and seated operators.

Another object of this invention is to provide a wall switch extender that is operable without modification on both toggle and rocker switches.

A final object of this invention is to reduce the rotational displacement necessary to toggle rocker switches, as well as provide a switch extender which will engage with short and long toggle switches as well as different sized rocker switches and operate them without modification or failure.

Other objects and advantages will become obvious when taken into consideration with the following drawings and specifications.

These and other objects, features, and advantages of the present invention, as well as the advantages thereof over existing prior art, which will become apparent from the description to follow, are accomplished by the improvements described in this specification and hereinafter described in the following detailed description which fully discloses the invention, but should not be considered as placing limitations thereon.

SUMMARY OF THE INVENTION

In accordance with the purposes of the present invention, as embodied and broadly described herein, the present invention provides an extension which will operate both toggle and rocker style light switches without modification and irrespective of wide variances in size and configurations of such switches.

The disclosed device, is adapted for engagement with a conventional light switch for increased usability and ergonomics especially for shorter people such as children, and seated individuals or those with minimal arm movement ability. The device is employed in operative engagement with a conventional light switch of the toggle or rocker variety, by engagement to the surrounding face plate and redirecting force imparted to an extension arm, to operate all manner of toggle switches and rocker switches without jamming or coming disengaged.

The device includes a front panel and an operatively engaged extension arm. The front panel is designed to affix to the conventional pair of mounting holes in the cover plate of a toggle or rocker switch positioned in either light switch's face plate via two long threaded members or bolts. The extension arm can rotate in an arced path about and is fastened to the front panel by a fastener which allows for such rotation such as a short bolt, washer and nut, which are fastened loosely to allow for free rotation. Screw caps can be used to hide the long and short bolts heads for increased aesthetics.

The front panel herein is designed to improve the aesthetics of the device as well as maintaining the position and path of the extension arm to operate and maintain operable contact with the light switch. The front panel contains several standoff ribs that sets the offset distance between it and the light switch's face plate. The standoff ribs additionally act to stiffen the front panel and act as additional stops for the extension arm.

The back face of the front panel additionally contains an offset bridge which acts as the primary stop for the rotation of the extension arm.

By holding and rotating the handle of the extension arm in a arc or rotational path about the pivot provided by the bolt engaged with the front panel in a first direction, the user can employ the device to flip the toggle switch of a conventional wall switch.

For conventional wall switches which employs a toggle switch, a toggle oculus in the extension arm is designed to surround and thus translate the toggle switch with user force on the extension arm. The shape of the device is designed such that, with minimal effort, rotating the extension arm clockwise, translates the toggle switch downwards and visa versa.

Another mode of the device which is particularly preferred solves the problem which is caused by different lengths of toggle switches and differing thicknesses of switch plates. This problem has been exacerbated in recent years due to the increase in manufacturers of both toggle switches and plates, and the wide divergence in their respective configurations. Thus a short toggle switch communicating through a thick switch plate does not protrude sufficiently to be operated by previous switch extenders. By the inclusion of projecting members at opposing positions surrounding the toggle-engaging aperture, the device herein has solved the problem of the toggle disengaging from the aperture, and not operating.

For use of the device with conventional wall switches of the rocker variety, the extension arm also contains a first or lower rocker paddle and a second or upper rocker paddle which respectively individually contact the lower and upper rocker faces to toggle the rocker switch down or up respectively upon rotation of the extension arm along the arced pathway.

The shapes of the cover plate and extension arm as shown are optimized to fit the largest variety of conventional light switches given the common toggle and rocker switch toggle mounting hole and toggle mounting holes geometries, but can be further optimized to fit any conventional light switches.

However again in recent years, due to ornamental design, manufacturing differences, and different manufacturers, the size of rocker switches has varied widely. In a second and preferred mode of the device herein, as with the solution to the toggle switch dilemma noted above, the device herein solves the problem of previous switch extenders which due to width and length differences of toggle switches, have failed to operate them or jammed.

Using a unique rocker projection from the arm, running substantially perpendicular to the pair of opposing projections operating the toggle switches, the device herein will operate any rocker switch irrespective of the length or width of the switch itself or its projection above the face plate. The rocker projections extends to a distal edge which has an arc thereon rising to a peak elevation above the arm in a center section and descending to distance closer to the arm at both ends.

This rocker projection extends from the arm at a position locating the distal edge slightly off the vertical centerline of the rocker switch, but centered in the convergence of the two angled portions of the rocker switch. Thus, the arm rocked in a first direction will turn on the rocker switch and rocked in a second direction from a resting position will turn off the rocker switch. Because the distal edge is located just off the centerline of the switch box holding the switch, the distal edge will always operatively engage a rocker switch be it narrow or extra wide, and operate it.

In another preferred mode, the extension arm can contain holes or means for engagement to affix additional extensions which increase the arm's ergonomics as well as length below or above an engaged switch. Such extensions can include but are not limited to: length extensions for higher switches, extensions to the floor for wheelchair activation or dog-manipulateable extensions such as ropes or tennis balls.

Preferably the cover plate and extension arm are formed of plastic for manufacturability, but can alternatively be produced from any material from a group including wood, glass, fiberglass or metal. Additionally, patterns, stickers or accessories can be painted or adhered to any of the surfaces of the cover plate or extension arm for increased aesthetics.

The fasteners employed such as bolts, washers and nuts can be composed of any commonly available fastener materials. These fastener components may additionally be supplemented by further fasteners to increase the use and durability of the device including but not limited to, additional bolts washers and nuts, lock nuts, lock washers, standoffs, spacers, or thread adhesive.

Finally, the projections or operative paddles are preferably manufactured from a material which is durable but will not mar the conventional existing wall switch's rocker switch. Such materials include but are not limited to: delrin, wood, polyethylene, polypropylene or other non-marring plastics, metals or organic materials.

Additionally, bumpers can be adhered to the tips of the projections or paddles to further prevent marring. Such bumpers can be produced from one or a combination of padding materials from a group including, rubber, wood, polyethylene, polypropylene teflon, paper, or other non-marring polymeric materials, metals or organic materials.

With respect to the above description, before explaining at least one preferred embodiment of the herein disclosed invention in detail, it is to be understood that the invention is not limited in its application to the details of construction and to the arrangement of the components in the following description or illustrated in the drawings. The device herein described and disclosed in the various modes and combinations is also capable of other embodiments and of being practiced and carried out in various ways which will be obvious to those skilled in the art. Any such alternative configuration as would occur to those skilled in the art is considered within the scope of this patent. Also, it is to be understood that the phraseology and terminology employed herein are for the purpose of description and should not be regarded as limiting.

As such, those skilled in the art will appreciate that the conception upon which this disclosure is based may readily be utilized as a basis for designing of light switch activation extensions for carrying out the several purposes of the present disclosed device. It is important, therefore, that the claims be regarded as including such equivalent construction and methodology insofar as they do not depart from the spirit and scope of the present invention.

BRIEF DESCRIPTION OF DRAWING FIGURES

The accompanying drawings, which are incorporated herein and form a part of the specification, illustrate some, but not the only nor exclusive examples of embodiments and/or features of the disclosed device. It is intended that the embodiments and figures disclosed herein are to be considered illustrative of the invention herein, rather than limiting in any fashion. In the drawings:

FIG. 1 depicts an exploded perspective view of the invention and its relation to a conventional wall switch of the toggle type.

FIG. 2 displays an exploded perspective view of the invention and its relation to a conventional wall switch of the rocker type.

Figure 5:
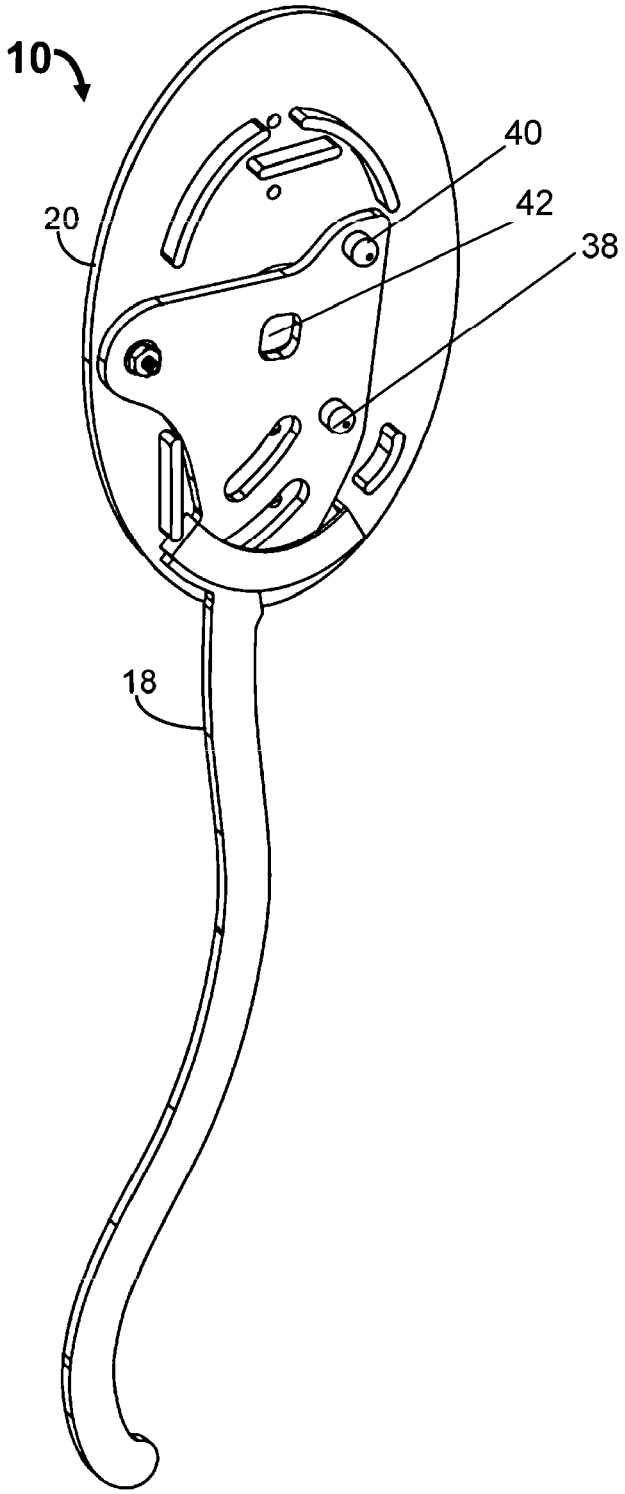

FIG. 5 displays a rear perspective view of the device.

Figure 6:
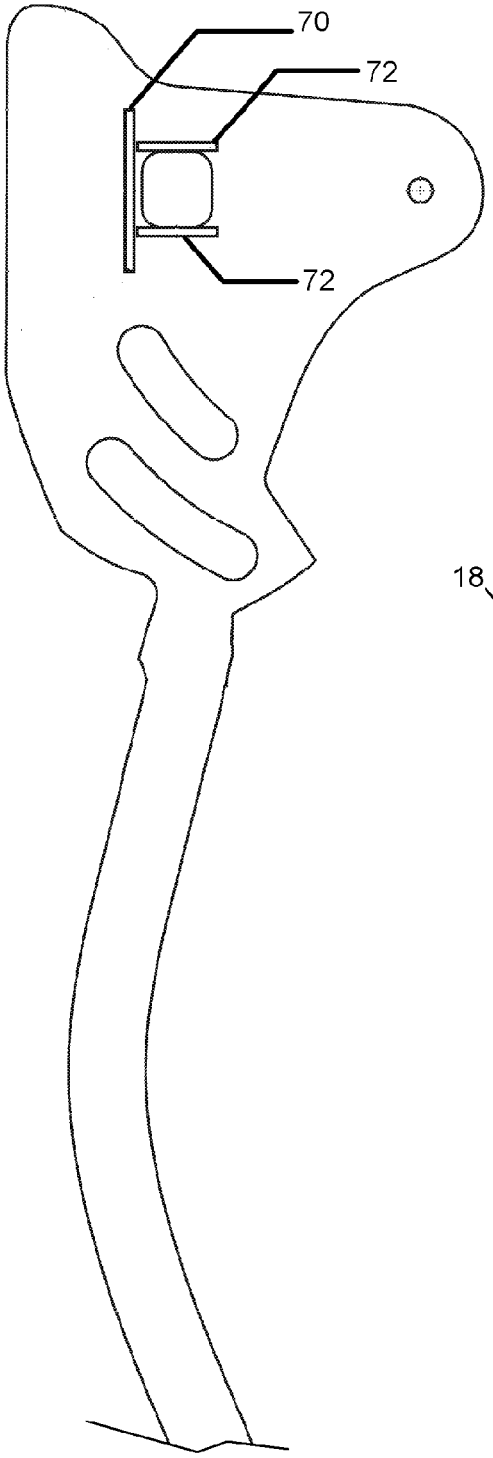

FIG. 6 depicts a second preferred mode of the extension arm adapted for all sizes of both toggle switches and rocker switches.

Figure 7:
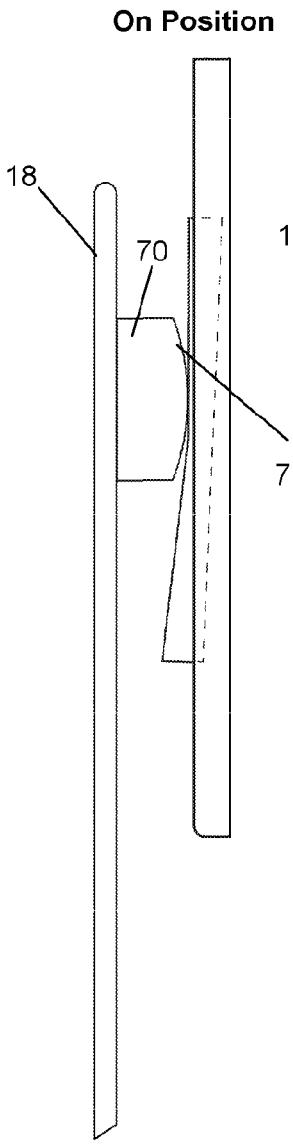

FIG. 7 depicts a side view of the extension arm of FIG. 6 showing the arched distal end of a rocker projection moving to depress the toggle when rotated.

Figure 8:
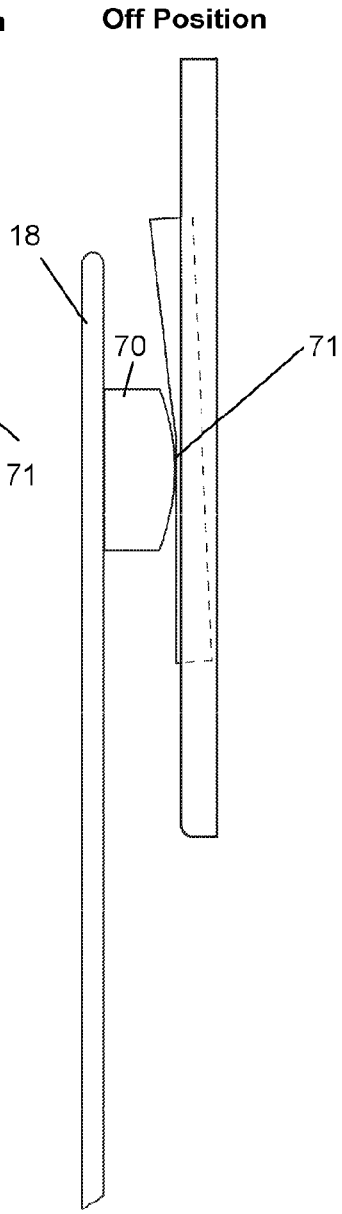

FIG. 8 depicts another side view of the device of FIG. 6 showing the movement in the opposite direction to turn off the light when the arm is moved in a second direction.

Figure 9:
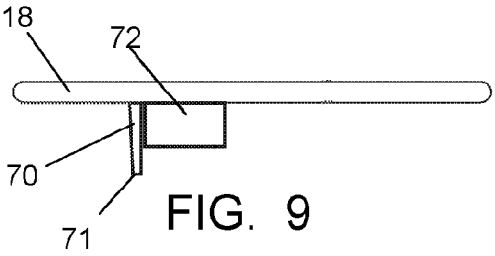

FIG. 9 shows a top view of the device of FIG. 6 depicting one of the two projections extending on opposite sides of the aperture for the toggle switch, and the off center positioning of the rocker projection.

Figure 10:
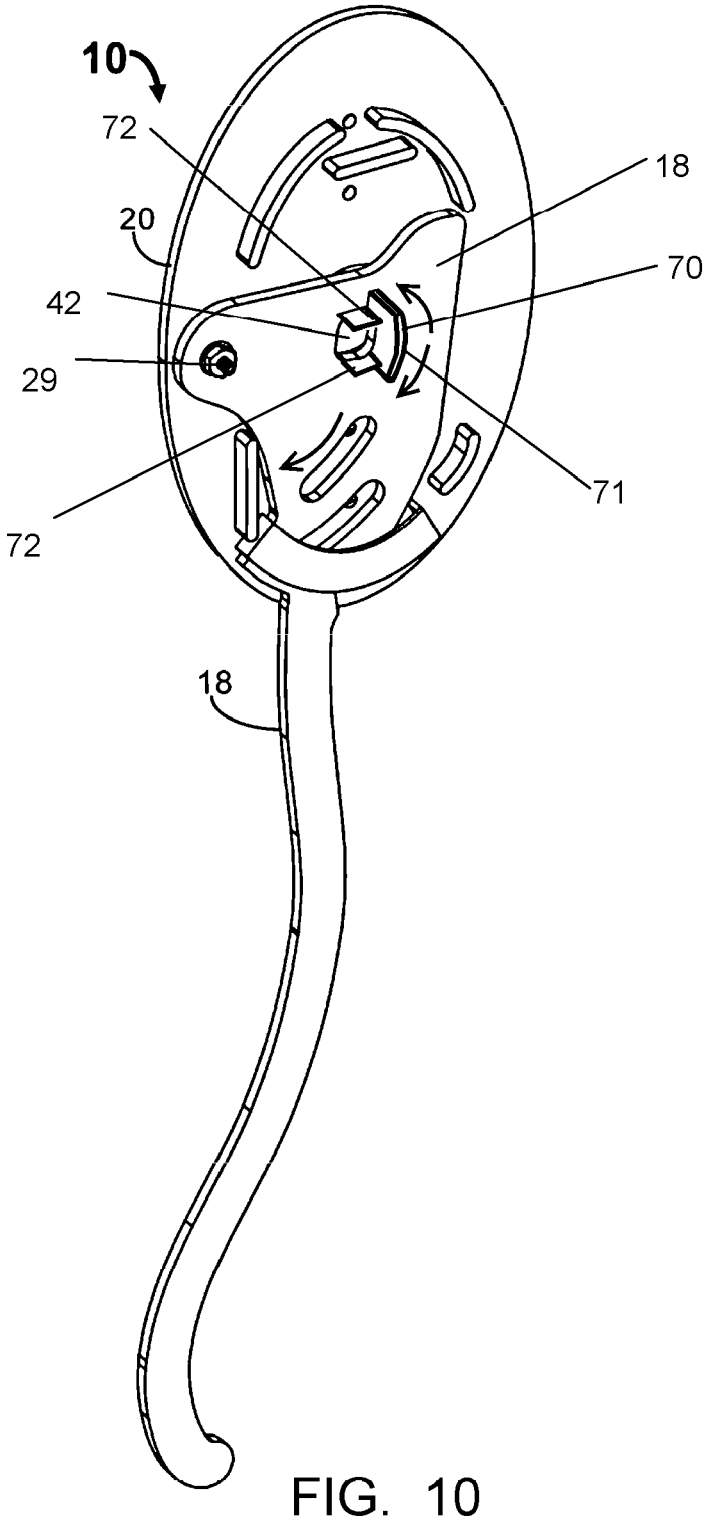

FIG. 10 depicts the arm of FIG. 6, operatively engaged to rotate along an arched path with a mounting plate.

DETAILED DESCRIPTION OF THE INVENTION

Figure 1:
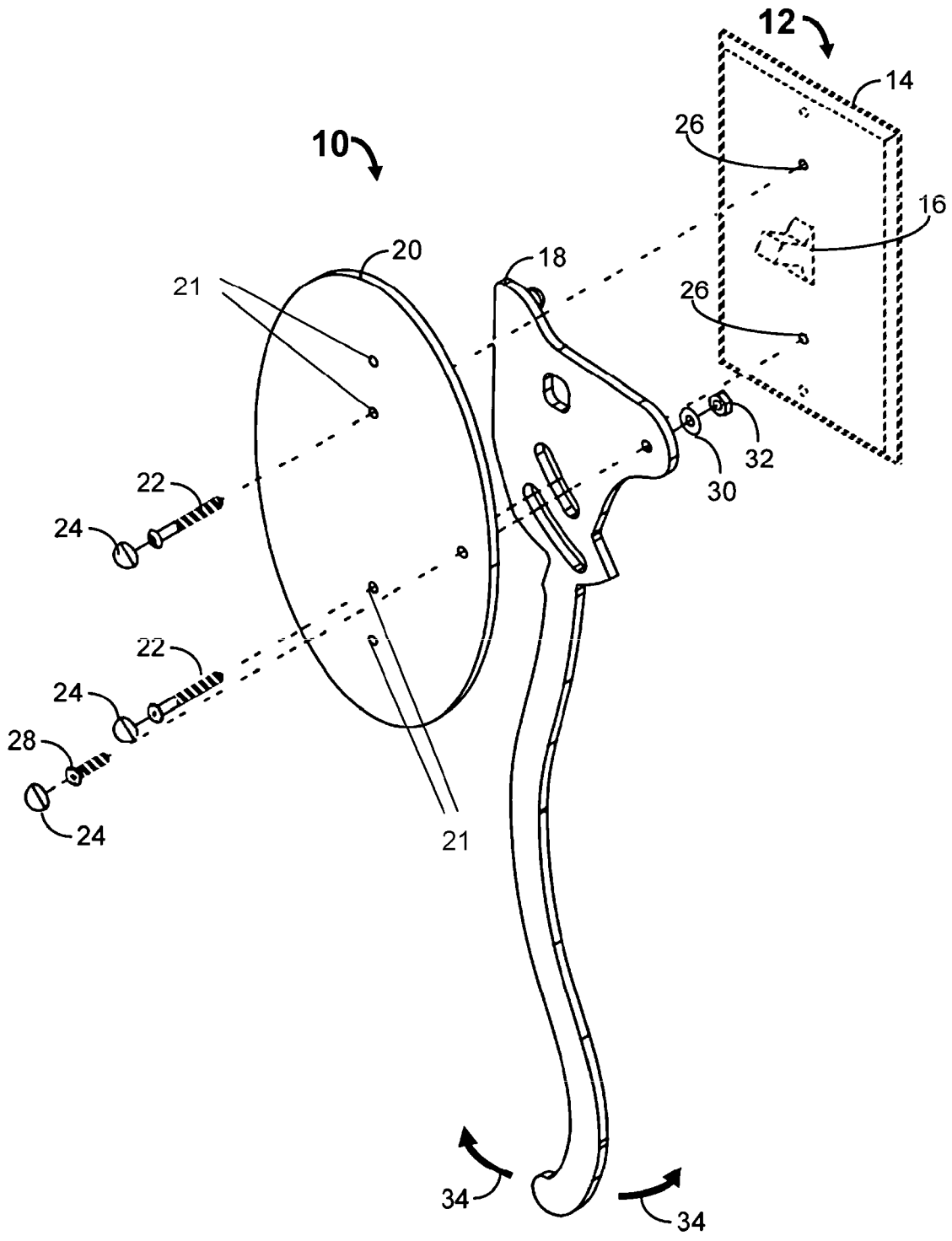
Figure 2:
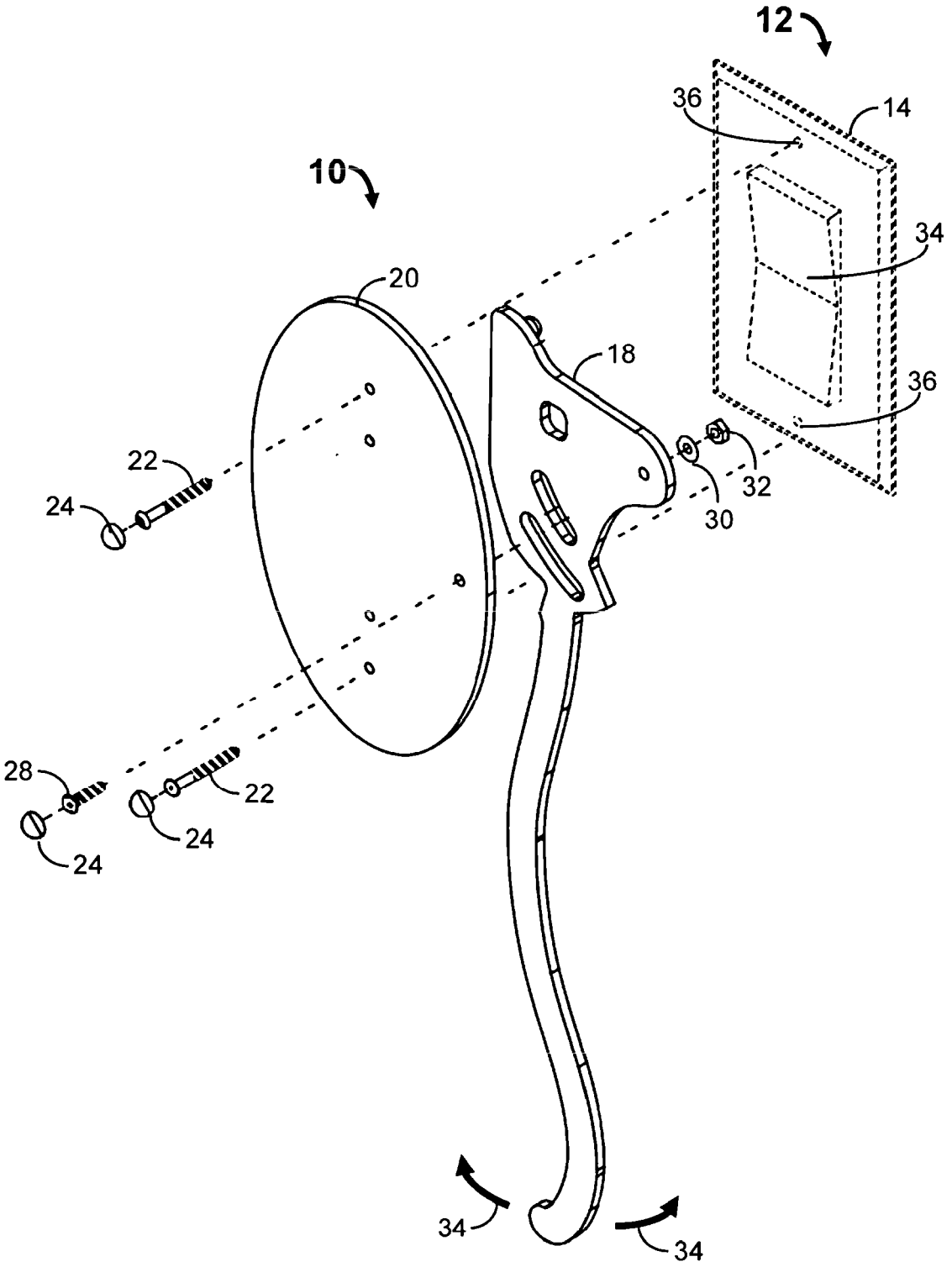

Now referring to drawings in FIGS. 1-10, wherein similar components are identified by like reference numerals, there is seem the device 10 which is designed for conventional light switch 12. As seen in FIG. 1, the device 10 is employed to adapt a conventional light switch 12 of the toggle variety 16, by adhering to a surrounding face plate 14 thereof and directing force toward the toggle switch 16 which activates an electric light.

The device 10 includes a front panel 20 and an operatively engaged extension arm 18. The front panel 20 is adapted with a plurality of apertures 21 in a spaced arrangement allowing the employment of fasteners to affix the front panel 20, through two opposing apertures 21, to an engagement with two mounting holes 26 in a toggle style switch or the two holes 36 of a rocker style switch communicating through a face plate 14. Such fasteners can be for instance, screws 22.

The extension arm 18 can rotate about and is fastened to the front panel 20 on a pivot point which as shown is provided by a bolt 28, washer 30 and nut 32 which are fastened loosely to allow for free rotation. Screw caps 24 can be used to hide the long and short screws 22, 28, heads for increased aesthetics. The extension arm 18 might be engaged to a pivot point during manufacture also, by forming such as part of the front panel 20 in plastic or other material, and engaging the extension arm 18 thereon, so any rotational or pivoting engagement of the extension arm 18 as would occur to those skilled in the art, is anticipated within the scope of this patent.

The extension arm 18, is engaged adjacent or closer to one side of the front panel 20 and consequently a rotation on the pivot point, at this first side, causes an arced movement of the other sections of the extension arm 18 spaced from the pivot point.

The front panel 20 is designed to improve the aesthetics of the device 10 as well as constraining the extension arm 18 to run along the arched pathway defined by the rotational connection at the pivot point. The front panel 20 also maintains the extension arm 18 in operative contact with the light switch 12 of either type.

Figure 3:
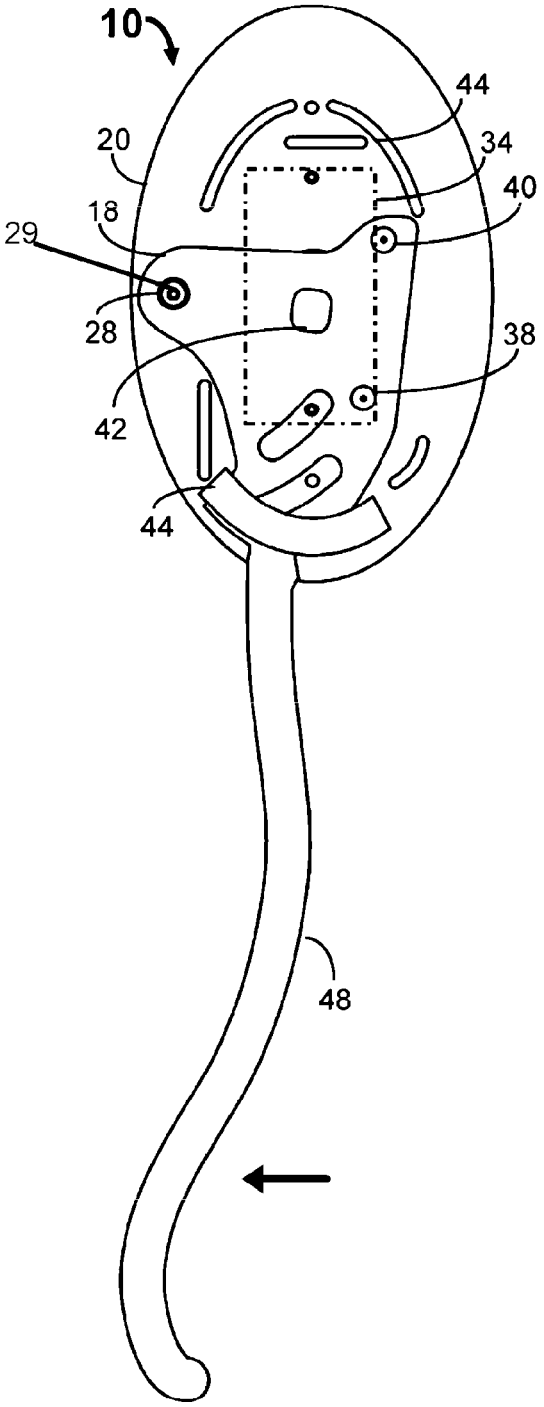
FIG. 3 shows a rear view of the device in its lower configuration.
Figure 4:
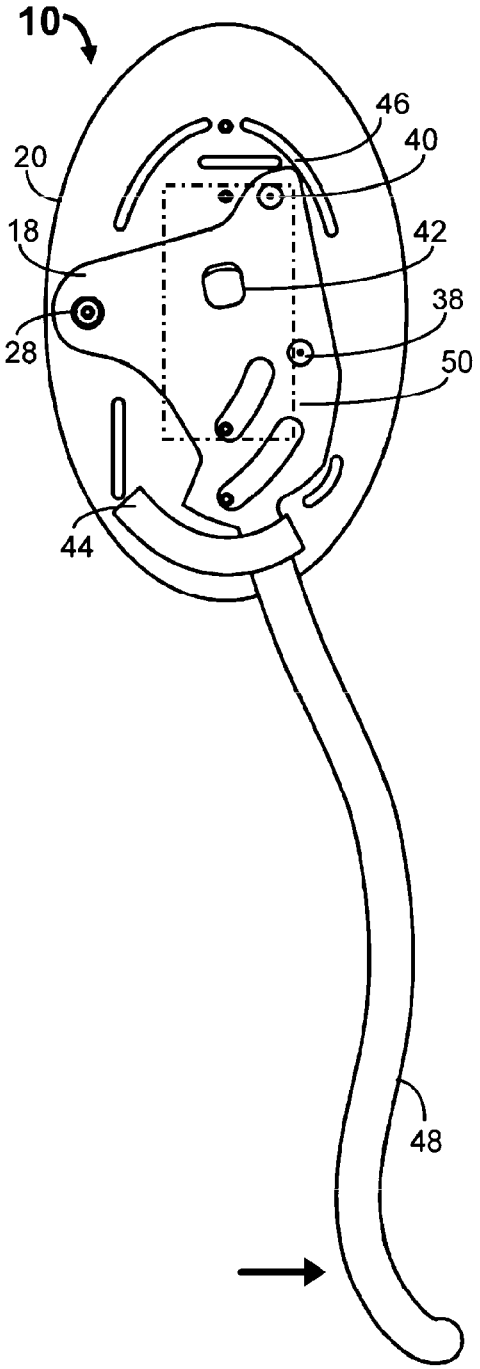
FIG. 4 depicts a rear view of the device in it's upper configuration.

FIGS. 3 and 4 further display the rear side of the front panel 20, showing the rotational movement of the arm 18 about the pivot point 29. The arm 18 has a plurality of standoff ribs 44 which defines an offset distance between the arm 18 and face plate 14. The standoff ribs 44 additionally provide support and thereby provide a means for stiffening the front panel 20. In the current preferred mode of the device 10 the standoff ribs 44 also act as additional stops for the movement of the extension arm 18 around the pivot point 29. The back face of the front panel additionally contains an offset bridge 44 which acts as the primary stop for the rotation of the extension arm 18.

By touching and pushing the handle 48 extending from the extension arm 18 causing a rotation about the pivot point 29, on the front panel 20, in a direction shown by arrow 34, the user can employ the device to flip the toggle switch 16 of a conventional wall switch 12 either on, or off, depending on the direction the handle 48 is pushed.

For conventional wall switches 12 which employs a toggle switch 16, a toggle oculus 42 in the extension arm 18 is designed to surround the distal end of the toggle switch 16, and thus translate the toggle switch 16 with user force on the handle 48. The shape of the device 10 is designed such that, with minimal effort, rotating the extension arm 18 clockwise, per FIG. 3, causes an arced movement of the toggle oculus 42 to thereby pivot the toggle switch 16 down, and rotating the extension arm counter clockwise as in FIG. 4, will move the oculus along an arced pathway in the reverse, to flip the toggle switch 16 upward.

For use of the device 10 with wall switches 12 of the rocker variety 34, the extension arm 18 may also include a first or lower rocker paddle 38 and a second or upper rocker paddle 40. As can be seen in FIGS. 3 and 4, both of the rocker paddles follow the arced pathway determined by their position on the extension arm 18 opposite the pivot point 29, allowing them to follow a curved pathway to contact either the lower and upper rocker faces, on the rocker variety 34 switch, to toggle the wall switch 12 down or up respectively upon rotation of the extension arm 18 initiated by pushing on the handle 48. The curved or domed shape of the paddles 38 and 40 are preferred to allow smooth transition and are further shown in FIG. 5.

FIGS. 3 and 4 display the geometrical relationship between the rocker switch shown as the rocker silhouette 50 and the upper and lower projecting paddles 40 38. As can be seen, both respective paddles 38 and 40, follow an arc during rotation of the extension arm 18 to traverse over a side edge of the rocker switch to flip it up or down. This arc in the pathway has in experimentation show to be beneficial in dealing with differing sized rocker switches.

The shapes of the cover plate 20 and extension arm 18 as shown are optimized to fit the largest variety of conventional light switches 12 given the common toggle and rocker switch 16 34 toggle mounting hole 26 and toggle mounting holes 36 geometries, but can be further optimized to fit any conventional light switches 12.

In a another preferred mode of the device 10, the extension arm 18 can include passages or apertures as fastening features to affix extensions which increase the arm's 18 ergonomics. Such extensions can include but are not limited to: length extensions for higher switches, extensions to the floor for wheelchair activation or dog-manipulatable extensions such as ropes or tennis balls.

Preferably the cover plate 20 and extension arm 18 are made of plastic for manufacturability, but can alternatively be produced from any material in a list containing but not limited to: wood, glass, fiberglass or metal. Additionally, patterns, stickers or accessories can be painted or adhered to any of the surfaces of the cover plate 20 or extension arm 18 for increased aesthetics.

The screws 22 28, washer 30 and nut 32 can be formed of any commonly available fastener materials which will not break under the load on the device 10 such as metal, plastic, or composites. These fastener components may additionally be supplemented by further fasteners to increase the use and durability of the device 10 including but not limited to, additional screws washers and nuts, lock nuts, lock washers, standoffs, spacers, or thread adhesive.

Still further, the projecting paddles 38, and 40, are preferably manufactured from a material which is durable but will not mar the conventional wall switch 12 of the rocker switch 34 category. Such materials include but are not limited to: delrin, wood, polyethylene, polypropylene or other non-marring plastics, metals or organic materials.

Additionally, bumpers can be adhered to the tips of the paddles 38 40 to further prevent marring. Such bumpers can be produced from any material in a list containing but not limited to: felt, rubber, wood, polyethylene, polypropylene or other non-marring plastics, metals or organic materials.

In a particularly preferred mode of the device 10 herein, shown in FIGS. 6-10, a solution to the toggle switch dilemma noted above is provided which eliminates the problem of previous switch extenders which jammed or failed to operate due to the wide variances in toggle switch length to the distal end, and the width and length of rocker switches.

Using a unique first projection 70 extending from the arm 18, running substantially perpendicular to the pair of opposing secondary projections 72 positioned on opposite sides of the toggle oculus 42 for engaging and operating the toggle switches 16, the device 10 herein in this preferred configuration, will operate any rocker switch 34 irrespective of the length or width of the rocker switch 34 itself or the distance of its projection above a surrounding face plate.

The first projection 70 extends to a distal edge 71 which has a curve or arc thereon, which rises to a peak elevation above the arm 18 in a center section and descends to distance closer to the arm 18 at both ends.

This first projection 70 extends from the arm 18 at a position locating the distal edge 71 slightly off the vertical centerline, of the rocker switch 34, when the arm 18 is in the engagement with the pivot point 29. Thus, the arm 18 when pivoting on the pivot point 29 in a first direction will cause the distal end 71 of the first projection 70 to move in a arc toward one angled end of the rocker switch 34 and when rotated around the pivot point 29 in a second direction, follow an arced pathway to contact the opposing angled surface of the rocker switch 34 and turn off the rocker switch 34.

Because the distal edge 71 is located just off the centerline of the switch box engaging the rocker switch 34, the distal edge 71 will always operatively engage or contact a surface of the rocker switch 34 whether it is configured narrow or extra wide, since all such switches by default, center the switch face, with the center of the switch box.

Another mode of the device 10 which is particularly preferred, solves the ongoing problem of differing lengths to the distal end of toggle switches 16 in their extension above the face plate. Short toggle switches 16 which abound in the current art, or communicating through a thick switch plate, will not protrude sufficiently through an aperture toggle oculus 42 to be operated by arm 18 movement. However experimentation has shown, that the inclusion of the secondary projections 72 at or adjacent opposing positions on the toggle-engaging toggle aperture oculus 42. The secondary projections 72 serve to prevent the distal end of the toggle switch 16 from disengagement from the arm 18, and thereby maintain the distal end of the toggle switch 16 in operative engagement with the arm 18 through the toggle oculus 42 or in-between the two opposing secondary projections 72. Consequently, the device as shown in FIGS. 6-10 with both the first projection 70 and the secondary projections 72 will operate virtually all toggle or rocker switches sold currently irrespective of their length width, or other differences and thus is especially preferred.

As noted, any of the different configurations and components can be employed with any other configuration or component shown and described herein. Additionally, while the present invention has been described herein with reference to particular embodiments thereof and steps in the method of production, a latitude of modifications, various changes and substitutions are intended in the foregoing disclosures, it will be appreciated that in some instance some features, or configurations, or steps in formation of the invention could be employed without a corresponding use of other features without departing from the scope of the invention as set forth in the following claims. All such changes, alternations and modifications as would occur to those skilled in the art are considered to be within the scope of this invention as broadly defined in the appended claims.

Further, the purpose of any abstract of this specification is to enable the U.S. Patent and Trademark Office, the public generally, and especially the scientists, engineers, and practitioners in the art who are not familiar with patent or legal terms or phraseology, to determine quickly from a cursory inspection the nature and essence of the technical disclosure of the application. Any such abstract is neither intended to define the invention of the application, which is measured by the claims, nor is it intended to be limiting, as to the scope of the invention in any way.

What is claimed is:

1. A light switch extender for permitting operation of a toggle actuated or rocker actuated light switch, by a user in a seated position, comprising:

an extension arm having a toggle oculus therein;

a panel adapted for an engagement over a cover plate surrounding a light switch;

said extension arm pivotally engaged on a back face of said panel at a pivot point;

said toggle oculus following an arced pathway around said pivot point during a pivot of said extension arm;

said toggle oculus adapted to engage about a said toggle of a said light switch;

a first projection extending from said extension arm to a distal end, said distal end extending in a curve running between a first end and second end of said first projection;

said first projection following a curved pathway around said pivot point during a pivot of said extension arm;

a pair of secondary projections extending from said extension arm in positions adjacent opposing sides of said toggle oculus;

said secondary projections positioning contact surfaces thereon for a said toggle having a length too short to communicate through said toggle oculus; and wherein said light switch extender will actuate either a toggle or a rocker style light switch whereby a pivot of said extension arm in a first direction will actuate said light switch to an on position and a pivot of said extension arm in an opposite direction of said first direction will actuate said light switch to an off position.

2. The light switch extender of claim 1 wherein said panel is adapted for an engagement over a cover plate surrounding a light switch with a pair of apertures communicating through said panel in positions to register with holes in said cover plate which are aligned with threaded passages configured to engage mounting screws for said cover plate, and panel connector screws which are configured to communicate through said aperures and said holes and threadably engage said threaded passages for said mounting screws.

3. The light switch extender of claim 2 wherein a bridge extends from said panel and defines a stop for pivoting of said extension arm in said first direction and for pivoting of said extension arm in said opposite direction of said first direction.

4. The light switch extender of claim 1 wherein a bridge extends from said panel and defines a stop for pivoting of said extension arm in said first direction and for pivoting of said extension arm in said opposite direction of said first direction.

* * * * *